United States Patent [19]

Kardouche

[11] 4,237,155

[45] Dec. 2, 1980

[54] ARTICLES AND METHODS FOR TREATING FABRICS

[75] Inventor: Nabil G. Kardouche, Cincinnati, Ohio

[73] Assignee: The Procter & Gamble Company, Cincinnati, Ohio

[21] Appl. No.: 34,801

[22] Filed: Apr. 30, 1979

Related U.S. Application Data

[63] Continuation-in-part of Ser. No. 925,594, Jul. 17, 1978, abandoned.

[51] Int. Cl.[3] ..... B05D 3/12

[52] U.S. Cl. ..... 427/242; 252/8.8; 252/305; 428/264; 428/265; 428/290; 428/315; 428/411; 428/537

[58] Field of Search ..... 427/242; 252/8.8 AJ, 252/8.8 AM, 8.8 R, 8.8, 305; 428/264, 265, 290, 315, 411, 537

[56] References Cited

U.S. PATENT DOCUMENTS

| | | | |
|---|---|---|---|
| 2,286,793 | 6/1942 | Dickey | 252/8.8 |
| 3,095,373 | 6/1963 | Blomfield | 252/8.8 |
| 3,686,025 | 8/1972 | Morton | 427/242 X |
| 3,806,359 | 4/1974 | McLaughlin | 427/242 |
| 3,895,128 | 7/1975 | Gaiser | 428/43 |
| 3,944,694 | 3/1976 | McQueary | 428/131 |
| 4,025,444 | 5/1977 | Murphy et al. | 252/8.8 |
| 4,077,891 | 3/1978 | Beimesch | 252/8.8 |

FOREIGN PATENT DOCUMENTS

| | | | |
|---|---|---|---|
| 1247000 | 8/1967 | Fed. Rep. of Germany | 252/8.8 AM |
| 1514276 | 6/1978 | United Kingdom | 8/137 |

OTHER PUBLICATIONS

Du Brow, *Cationic Fabric Softeners,* In Soap & Chem. Spec., Apr. 1957, pp. 89, 91, 93, 95, and 97.

*Primary Examiner*—Evan K. Lawrence
*Attorney, Agent, or Firm*—Ronald L. Hemingway; Richard C. Witte

[57] ABSTRACT

Dryer-added fabric conditioning articles and methods utilizing, as a fabric conditioning agent, a carboxylic acid salt of a tertiary amine wherein the amine moiety contains at least one alkyl chain of from 12 to 20 carbon atoms.

19 Claims, No Drawings

ARTICLES AND METHODS FOR TREATING FABRICS

CROSS REFERENCE TO RELATED APPLICATION

This is a continuation-in-part of application Ser. No. 925,594 filed July 17, 1978 abandoned.

BACKGROUND OF THE INVENTION

The present invention pertains to articles and methods for providing softening and antistatic benefits to fabrics, and especially to the providing of these benefits by treatment of the fabrics in an automatic laundry dryer. More specifically, damp fabrics are contacted with a carboxylic acid salt of a long chain tertiary amine in an automatic clothes dryer and are thereby provided with a soft, antistatic finish concurrently with the drying operation. The softening and antistatic carboxylic acid salt of a long chain tertiary amine is preferably employed in combination with a dispensing means adapted for use in an automatic dryer.

Treatment in an automatic clothes dryer has been shown to be an effective means for imparting desirable tactile properties to fabrics. For example, it is becoming common to soften fabrics in an automatic clothes dryer rather than during the rinse cycle of a laundering operation. (See Gaiser, U.S. Pat. No. 3,442,692, issued May 6, 1969.)

Fabric "softness" is an expression well-defined in the art and is usually understood to be that quality of the treated fabric whereby its handle or texture is smooth, pliable and fluffy to the touch. Various chemical compounds have long been known to possess the ability to soften fabrics when applied to them during a laundering operation, particularly during the rinse cycle.

Fabric softness also connotes the absence of static "cling" in the fabrics, and the commonly used cationic fabric softeners provide both softening and antistatic benefits when applied to fabrics. The imparting of softening/antistatic benefits to fabrics can also be referred to by the more generic term, fabric conditioning.

Fatty alkyl cationic antistatic softening compounds and compositions designed for application to fabrics in an automatic dryer have been the subject of recent innovations. (See, for example, Furgal, U.S. Pat. No. 3,634,947, issued Jan. 18, 1972, and Morton, U.S. Pat. No. 3,686,025, issued Aug. 22, 1972.) Other fatty materials have been suggested for use as dryer-added fabric softeners/antistats. (See, for example, Hewitt et al., U.S. Pat. No. 3,676,199, issued July 11, 1972, and Zaki et al., U.S. Pat. No. 4,022,938, issued May 10, 1977.)

The use of fatty amines and the salts of such amines as fabric conditioning agents in the washing and rinsing cycles of an automatic washer, as well as the drying cycle of an automatic dryer, has been disclosed. (See for example, Blomfield, U.S. Pat. No. 3,095,373, issued June 25, 1963; Gaiser, U.S. Pat. No. 3,442,692, issued May 6, 1969; Gaiser, U.S. Pat. No. 3,895,128, issued July 15, 1975; and South African Pat. No. 69/3923.) The use of amines in a dryer context, however, is accompanied by odor problems and/or softening of the paint used on interior dryer surfaces. U.S. Pat. No. 4,077,891, Beimesch et al., issued Mar. 7, 1978, describes formic acid salts of primary amines as acceptable softeners for use in the dryer in that they do not produce amine odors and they reduce paint softening problems. Although the use of formic acid salts of primary amines provides advantages in odor, paint softening and/or fabric softening performance over use of the corresponding free amines or other salts of the amines (such as the hydrochlorides), it is desired to obtain further improvements in these properties beyond those which are achieved with the primary amine formates.

It is, therefore, an object of the present invention to provide fabric softening articles for use in automatic dryers which are superior in odor and/or paint softening (i.e., less paint softening) and/or fabric softening performance, compared to similar articles which utilize primary amine formates as the fabric conditioning agent.

This and other objects are obtained herein, as will be seen from the following disclosure.

Additionally, tertiary amine salts of carboxylic acids have superior chemical stability, compared to primary and secondary amine carboxylate salts. For example, primary and secondary amine carboxylates tend to form amides when heated, e.g., during processing or use in the dryer. Also, they absorb carbon dioxide, thereby forming high melting carbamates which build up as an undesirable residue on treated fabrics.

SUMMARY OF THE INVENTION

The present invention encompasses an article of manufacture adapted for use to soften fabrics in an automatic laundry dryer comprising: (a) a fabric softening composition, which comprises, as its essential ingredient, a carboxylic acid salt of a tertiary amine having at least one long chain, as defined hereinafter, and (b) a dispensing means which provides for release of an effective amount of said composition to fabrics in the dryer at automatic dryer operating temperatures, i.e., 35° C.–115° C.

The invention also encompasses a method for imparting a softening and antistatic effect to fabrics in an automatic clothes dryer comprising tumbling said fabrics under heat in a clothes dryer with an effective, i.e., softening, amount of a composition comprising a carboxylic acid salt of a tertiary amine.

DESCRIPTION OF THE PREFERRED EMBODIMENT

Fabric Softening Compositions

Fabric softening compositions employed herein contain as their essential component a carboxylic acid salt of a tertiary amine which has at least one long aliphatic chain containing from about 12 to about 22 carbon atoms. Such compositions can also contain a variety of optional materials.

The tertiary amine salts are a direct product of the reaction between a tertiary amine and a carboxylic acid.

The tertiary amines utilized in the present invention have the formula

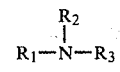

wherein $R_1$ is a long chain aliphatic group containing from 12 to 22 carbon atoms and $R_2$ and $R_3$ can be the same or different from each other and are selected from the group consisting of aliphatic groups containing from 1 to 22 carbon atoms, hydroxyalkyl groups of the formula $-R_4OH$ wherein $R_4$ is an alkylene group of 1 to 3 carbon atoms, and alkyl ether groups of the formula $R_5O(C_nH_{2n}O)_m$- wherein $R_5$ is alkyl or alkenyl of from 1 to 20 carbon atoms or hydrogen, n is 2 or 3 and m is from 1 to 20. Preferred amines are those wherein $R_1$ is an aliphatic chain containing from 12 to 22 carbon atoms, $R_2$ is an aliphatic chain of from 1 to 22 carbon atoms, and $R_3$ is an aliphatic chain of from 1 to 3 carbon atoms.

Examples of specific tertiary amines are:
lauryldimethylamine,
myristyldiethylamine,
stearyldimethylamine,
tallowdimethylamine,
coconutdimethylamine,
dilaurylmethylamine,
distearylmethylamine,
ditallowmethylamine,
oleyl dimethylamine,
dioleyl methylamine,
lauryldi(3-hydroxypropyl)amine,
stearyldi(2-hydroxyethyl)amine,
trilaurylamine,
laurylethylmethylamine,

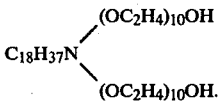

The carboxylic acids have the formula

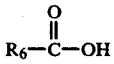

wherein $R_6$ can be hydrogen, or an unsubstituted alkyl, alkenyl, aryl, alkaryl and aralkyl of 1 to 22 carbon atoms, or substituted alkyl, alkenyl, aryl, alkaryl, or aralkyl of from 1 to 22 carbon atoms wherein the substituents are selected from the group consisting of halogen (e.g., Cl or Br), carboxyl, or hydroxyl. Preferred fatty acids are those wherein $R_6$ is a long chain, unsubstituted alkyl or alkenyl group of from 11 to 21 carbon atoms, more preferably 11 to 17 carbon atoms.

Examples of specific carboxylic acids are:
formic acid,
acetic acid,
lauric acid,
myristic acid,
palmitic acid,
stearic acid,
oleic acid,
oxalic acid,
adipic acid,
12-hydroxy stearic acid,
benzoic acid,
4-hydroxy benzoic acid,
3-chloro benzoic acid,
4-nitro benzoic acid,
4-ethyl benzoic acid,
4-(2-chloroethyl)benzoic acid,
phenylacetic acid,
(4-chlorophenyl)acetic acid,
(4-hydroxyphenyl)acetic acid, and
phthalic acid.

Preferred carboxylic acids are lauric, myristic, palmitic, stearic, oleic and mixtures thereof.

The amine salt can be formed by a simple addition reaction, well known in the art, wherein the tertiary amine is dissolved in a solvent such as methanol, ethanol, propanol, etc., and the acid is added to the amine solution. Alternatively, the amine and acid can simply be mixed and melted together with stirring to form the salt. The molten amine salt can then be solidified by cooling to room temperature. The amount of acid should desirably be at least stoichiometrically equivalent to the amount of amine since it is desirable that compositions of the invention be low in free amine content (the amine salts give better fabric softening performance than the free amines). If the acid used to form the amine salt is a polybasic acid (e.g., oxalic acid), the salt can be monobasic or polybasic, i.e., either one or more of the acid groups can be utilized to neutralize the amine.

The formation of amine salts proceeds according to the following reaction:

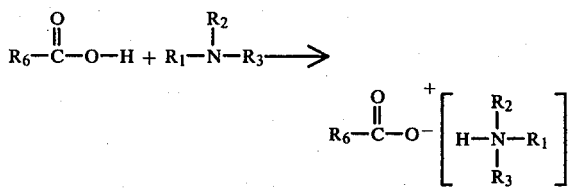

If the reaction is carried out in a lower alcohol solvent medium, the salt precipitates from solution, and may be recovered either by filtration and/or evaporation of the solvent. Preferably the amine and acid pair used in preparing amine salts of the present invention should be chosen so as to produce amine salts having a melting point within the range of from about 35° C. to 115° C. (more preferably 35° C. to 85° C.). Such salts will be solid at room temperature but will melt at typical dryer operating temperatures. Amine salts having melting points outside this range can be used in the present invention by formulating them into compositions which contain other materials (e.g., other softening agents as disclosed hereinafter) so that the formulated composition has a melting point within the desired range.

Preferred amine salts for use herein are those wherein the amine moiety is a $C_{12}$ to $C_{22}$ alkyl or alkenyl dimethyl amine or a di-$C_{12}$ to $C_{22}$ alkyl or alkenyl methyl amine, and the acid moiety is a $C_{12}$ to $C_{22}$ alkyl or alkenyl monocarboxylic acid. The amine and the acid, respectively, used to form the amine salt will often be of mixed chain lengths rather than single chain lengths, since these materials are normally derived from natural fats and oils, or synthetic processes which produce a mixture of chain lengths. Also, it is often desirable to utilize mixtures of different chain lengths in order to modify the physical or performance characteristics of the softening composition.

Specific preferred amine salts for use in the present invention are stearyldimethylamine stearate, stearyldimethylamine myristate, stearyldimethylamine palmitate, distearylmethylamine palmitate, distearylmethylamine laurate, and mixtures thereof. A particularly preferred mixture is stearyldimethylamine stearate and distearylmethylamine myristate, in a ratio of 1:10 to 10:1, preferably about 1:1.

OPTIONAL SOFTENING COMPOSITION COMPONENTS

Various additives can be used in combination with the aforedescribed tertiary amine salts in the softening compositions herein. Although not essential to the invention herein, certain fabric treating additives are particularly desirable and useful, e.g., perfumes, brightening agents, shrinkage controllers, spotting agents and the like. With respect to perfumes, it should be noted that the tertiary amine salts of the present invention are much more compatible with conventional perfume components such as aldehydes, ketones, and esters than are the primary amine formates described in U.S. Pat. No. 4,077,891, supra.

Additional fabric softener/antistat agents may also be used in combination with the tertiary amine salts. These agents are generally nonionic or cationic in nature.

The most common type of cationic softener/antistat materials are the cationic nitrogen-containing compounds such as quaternary ammonium compounds having one or two straight-chain organic groups of at least eight carbon atoms. Preferably, they have one or two such groups of from 12 to 22 carbon atoms. Preferred cation-active softener compounds include the quaternary ammonium softener/antistat compounds corresponding to the formula

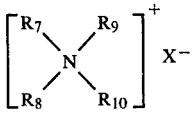

wherein $R_7$ is an aliphatic group of from 1 to 22 carbon atoms; $R_8$ is an aliphatic group having from 12 to 22 carbon atoms; $R_9$ and $R_{10}$ are each alkyl groups of from 1 to 3 carbon atoms; and X is an anion selected from halogen, acetate, phosphate, nitrate and methyl sulfate radicals.

Because of their excellent softening efficacy and ready availability, preferred cationic softener/antistat compounds which can be optionally included in the compositions herein are the dialkyl dimethyl ammonium methyl sulfates, wherein the aliphatic groups have from 12 to 22 carbon atoms and are derived from long-chain fatty acids, such as hydrogenated tallow. As employed herein, aliphatic is intended as including unsaturated compounds such as are present in aliphatic groups derived from naturally occurring fatty oils. The term "tallow" refers to fatty aliphatic groups derived from tallow fatty acids. Such fatty acids give rise to quaternary softener compounds wherein $R_7$ and $R_8$ have predominantly from 16 to 18 carbon atoms. The term "coconut" refers to fatty acid groups from coconut oil fatty acids. The coconut $R_7$ and $R_8$ groups have from about 8 to about 18 carbon atoms and predominate in $C_{12}$ to $C_{14}$ alkyl groups. Representative examples of quaternary softeners for use herein include tallow trimethyl ammonium chloride; ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; dihexadecyl dimethyl ammonium acetate; ditallow dipropyl ammonium phosphate; ditallow dimethyl ammonium nitrate; di(coconut-alkyl) dimethyl ammonium chloride.

An especially preferred class of quaternary ammonium softener/antistats correspond to the formula

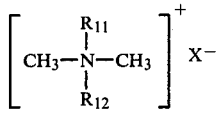

wherein $R_{11}$ and $R_{12}$ are each straight chain aliphatic groups of from 12 to 22 carbon atoms and X is halogen, e.g., chloride or methyl sulfate. Especially preferred are ditallow dimethyl ammonium methyl sulfate (or chloride) and di(hydrogenated tallow-alkyl) dimethyl ammonium methyl sulfate (or chloride) and di(coconut-alkyl) dimethyl ammonium methyl sulfate (or chloride), these compounds being preferred from the standpoint of good softening properties and ready availability.

Other suitable cation-active softener/antistat compounds which can optionally be included in the compositions herein are the quaternary imidazolinium salts. Preferred salts are those conforming to the formula

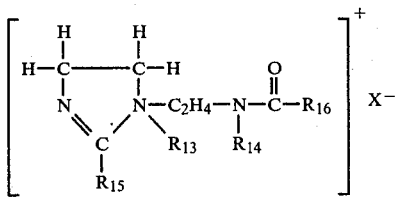

wherein $R_{13}$ is an alkyl containing from 1 to 4, preferably from 1 to 2 carbon atoms, $R_{14}$ is an alkyl containing from 1 to 4 carbon atoms or a hydrogen radical, $R_{15}$ is an alkyl containing from 1 to 22, preferably at least 15 carbon atoms or a hydrogen radical, $R_{16}$ is an alkyl containing from 8 to 22, preferably at least 15 carbon atoms, and X is an anion, preferably methylsulfate or chloride ions. Other suitable anions include those disclosed with reference to the cationic quaternary ammonium fabric antistat/softeners described hereinbefore. Particularly preferred are those imidazolinium compounds in which both $R_{15}$ and $R_{16}$ are alkyls of from 12 to 22 carbon atoms, e.g., 1-methyl-1-[(stearoylamide)ethyl]-2-heptadecyl-4,5-dihydroimidazolinium methyl sulfate; 1-methyl-1-[(palmitoylamide)ethyl]-2-octadecyl-4,5-dihydroimidazolinium chloride and 1-methyl-1-[(tallowamide)ethyl]-2-tallow-imidazolinium methyl sulfate.

Other cationic quaternary ammonium fabric softener/antistats which are useful herein include, for example, alkyl ($C_{12}$ to $C_{22}$)-pyridinium chlorides, alkyl ($C_{12}$ to $C_{22}$)-alkyl ($C_1$ to $C_3$)-morpholinium chlorides, and quaternary derivatives of amino acids and amino esters.

Nonionic fabric softener/antistat materials include a wide variety of materials including fatty esters, fatty alcohols and their derivatives, diamine compounds and the like. One preferred type of nonionic fabric antistat/-softener material comprises the esterified cyclic dehydration products of sorbitol, i.e., sorbitan esters. See U.S. Pat. No. 4,022,938, Zaki et al., issued May 10, 1977, incorporated herein by reference.

Sorbitan mono- and di-esters of lauric, myristic, palmitic, stearic, and behenic acids are particularly useful herein for conditioning the fabrics being treated. Mixed sorbitan esters, e.g., mixtures of the foregoing esters, and mixtures prepared by esterifying sorbitan with fatty acid mixtures such as the mixed tallow and hydrogenated palm oil fatty acids, are useful herein and are economically attractive. Unsaturated $C_{10}$–$C_{18}$ sorbitan esters, e.g., sorbitan mono-oleate, usually are present in such mixtures. It is to be recognized that all sorbitan esters, and mixtures thereof, which are essentially water-insoluble and which have fatty hydrocarbyl "tails," are useful fabric antistat/softener materials in the context of the present invention.

The preferred alkyl sorbitan ester fabric softener/antistat materials herein comprise sorbitan monolaurate, sorbitan monomyristate, sorbitan monopalmitate, sorbitan monostearate, sorbitan monobehenate, sorbitan dilaurate, sorbitan dimyristate, sorbitan dipalmitate, sorbitan distearate, sorbitan dibehenate, and mixtures thereof, the mixed coconutalkyl sorbitan mono- and di-esters and the mixed tallowalkyl sorbitan mono-and di-esters. The tri- and tetra-esters of sorbitan with lauric, myristic, palmitic, stearic and behenic acids, and mixtures thereof, are also useful herein.

Another useful type of nonionic fabric softener/antistat material encompasses the substantially water-insoluble compounds chemically classified as fatty alcohols. Mono-ols, di-ols, and poly-ols having the requisite melting points and water-insolubility properties set forth above are useful herein. Such alcohol-type fabric conditioning materials also include the mono- and di-fatty glycerides which contain at least one "free" OH group.

All manner of water-insoluble, high melting alcohols (including mono- and di-glycerides), are useful herein, inasmuch as all such materials are, to some extent, fabric substantive. Of course, it is desirable to use those materials which are relatively colorless, so as not to alter the color of the fabrics being treated. Toxicologically acceptable materials which are safe for use in contact with skin should be chosen.

A preferred type of unesterified alcohol useful herein includes the higher melting members of the so-called fatty alcohol class. Although once limited to alcohols obtained from natural fats and oils, the term "fatty alcohols" has come to mean those alcohols which correspond to the alcohols obtainable from fats and oils, and all such alcohols can be made by synthetic processes. Fatty alcohols prepared by the mild oxidation of petroleum products are useful herein.

Another type of material which can be classified as an alcohol and which can be employed as an optional softener/antistat material in the instant invention encompasses various esters of polyhydric alcohols. Such "ester-alcohol" materials which have a melting point within the range of about 35° C. to 100° C. and which are substantially water-insoluble can be employed herein when they contain at least one free hydroxyl group, i.e., when they can be classified chemically as alcohols.

The alcoholic di-esters of glycerol useful herein include both the 1,3-di-glycerides and the 1,2-di-glycerides. In particular, di-glycerides containing two $C_8$–$C_{20}$, preferably $C_{10}$–$C_{18}$, alkyl groups in the molecule are useful fabric conditioning agents.

Nonlimiting examples of ester-alcohols useful herein include: Glycerol-1,2-dilaurate; glycerol-1,3-dilaurate; glycerol-1,2-dimyristate; glycerol-1,3-dimyristate; glycerol-1,2-dipalmitate; glycerol-1,3-dipalmitate; glycerol-1,2-distearate and glycerol-1,3-distearate. Mixed glycerides available from mixed tallowalkyl fatty acids, i.e., 1,2-ditallowalkyl glycerol and 1,3-ditallowalkyl glycerol, are economically attractive for use herein. The foregoing ester-alcohols are preferred for use herein due to their ready availability from natural fats and oils.

Mono- and di-ether alcohols, especially the $C_{10}$–$C_{18}$ di-ether alcohols having at least one free -OH group, also fall within the definition of alcohols useful as optional fabric softener/antistat materials herein. The ether-alcohols can be prepared by the classic Williamson ether synthesis. As with the ester-alcohols, the reaction conditions are chosen such that at least one free, unetherified -OH group remains in the molecule.

Ether-alcohols useful herein include glycerol-1, 2-dilauryl ether; glycerol-1,3-distearyl ether; and butane tetra-ol-1,2,3-trioctanyl ether.

While not essential, liquids which serve as a carrier for the softening agents and other materials can also be employed as part of the softening compositions herein. Such liquids can be used, for example, to more evenly impregnate an absorbent substrate with the softening composition when such an absorbent substrate is employed (as discussed hereinafter) as the dispensing means for the instant compositions. When a liquid carrier is so used, it should preferably be inert or stable with the fabric softeners. Moreover, a liquid carrier used in substrate impregnation should be substantially evaporated at room temperatures, and the residue (i.e., the softening agent and other optional materials) should then be sufficiently hardened so as not to run or drip off the substrate, or cause the substrate to stick together when folded. Isopropyl alcohol or isopropyl alcohol/-water mixtures are the preferred liquid carriers for substrate impregnation purposes. Methanol, ethanol, acetone, ethylene glycol, propylene glycol, alcohol ethoxylate nonionic surfactants and/or liquified fluorocarbons such as dichlorofluoroethane and dichlorodifluoromethane can also be used as carriers either for dispensing the softening compositions in the dryer, for introducing the softening compositions into the dryer dispensing means or for facilitating release of the softening compositions from the dryer dispensing means.

Clays can be added to the compositions of the invention in an amount of from about 0.5% to about 50% of the total composition. See U.S. Pat. No. 4,073,996, Bedenk et al., issued Feb. 14, 1978. Clay promotes even release of the softening composition from substrate-type dispensing means (such as woven or nonwoven cloth sheets) thereby minimizing any tendency to stain the treated fabrics which might be caused by uneven transfer of softener to them. Smectite clays are particularly preferred clays for use herein. An example of a smectite clay is Gelwhite GP, which is marketed by Georgia Kaolin Co. Another additive which can be used to promote even release of the softener composition from a substrate-type dispensing means is a mixture of about 1.5% Carbopol resin (B. F. Goodrich Co.) and 4% glycerine, based on the total weight of the composition.

Other additives can include anticreasing agents, finishing agents, fumigants, lubricants, fungicides, and sizing agents. Specific examples of useful additives disclosed herein can be found in any current Year Book of the American Association of Textile Chemists and Colorists. Any additive used should be compatible with the softening agents.

The amounts of some additives (e.g., perfume and brighteners) that are generally used in combination with the softening agents are small, being in the range of from 0.01% to 10% by weight of the softening composition. Other additives such as the optional antistat/softener agents and liquid carriers can be present in larger amounts. Such optional and/or liquid carrier materials can be present in fabric softening compositions to the extent of from about 0.01% to 50% or more by weight of the softening composition. All percentages herein are "by weight" unless specified otherwise.

A highly preferred softening composition herein contains from about 5% to 100% (preferably 50% to 100%) by weight of the composition of the essential acid salt of a tertiary amine and from about 0% to 95% (preferably 0% to 50%) by weight of the composition of an optical softener/antistat agent. Preferred optional softener/antistatic agents are ditallow dimethyl ammonium methyl sulfate, sorbitan monostearate and mixtures of these materials. Highly preferred mixtures are those wherein the ratios of the two are in the range of about 80/20 to about 20/80.

A liquid carrier, if used, will, of course, be present in the softening composition in relatively large amounts, especially if the presence of such a carrier is useful in dispensing the softening composition in the dryer (in an aerosol device, for example).

DISPENSING MEANS

The tertiary amine acid salt-containing softening compositions can be employed by simply adding a measured amount into the dryer, e.g., as liquid dispersion. However, in a preferred embodiment, the softening composition is provided as part of an article of manufacture in combination with a dispensing means which effectively releases the composition in an automatic clothes dryer. Such dispensing means can be designed for single usage or for multiple uses.

One such article comprises a sponge material releasably enclosing enough softener composition to impart effectively fabric softness during the treating of several loads of clothes. This multi-use article can be made by filling a hollow sponge with about 20 grams of the softening composition. In use, the composition melts and leaches out through the pores of the sponge to soften fabrics. Such a filled sponge can be used to treat several loads of fabrics in conventional dryers, and has the advantage that it can remain in the dryer after use and is not likely to be misplaced or lost.

Another article comprises a cloth or paper bag releasably enclosing the composition and sealed with a melt of the composition, which is subsequently hardened to form a heat-sensitive seal. The action and heat of the dryer melt the seal, thereby opening the bag and releasing the salt to perform its softening function.

Still another article comprises an aerosol cannister containing the above-described softening compositions under pressure. The compositions can be dispensed from this aerosol article onto the interior surface of the cold dryer drum prior to the addition of fabrics in the manner more fully described in Rudy et al., U.S. Pat. No. 3,650,816, issued Mar. 21, 1972, incorporated herein by reference.

Other devices and articles suitable for dispensing the softening material into automatic dryers include those described in Dillarstone, U.S. Pat. No. 3,736,668, issued June 5, 1973; Compa et al., U.S. Pat. No. 3,701,202, issued Oct. 31, 1972; Furgal, U.S. Pat. No. 3,634,947, issued Jan. 18, 1972; Hoeflin, U.S. Pat. No. 3,633,538, issued Jan. 11, 1972; and Rumsey, U.S. Pat. No. 3,435,537, issued Apr. 1, 1969. See also Murphy et al., U.S. Pat. No. 4,085,052, issued Apr. 18, 1978. All of these patents are incorporated herein by reference.

A highly preferred article herein comprises the tertiary amine salt-containing composition releasably affixed to a sheet of paper or woven or nonwoven cloth substrate or a sheet of foamed plastic such as polyurethane. When such an article is placed in an automatic laundry dryer, the heat and tumbling action of the dryer removes the composition from the substrate and deposits it on the fabrics.

The sheet conformation has several advantages. For example, effective amounts of the composition for use in conventional dryers can be easily sorbed onto and into the sheet substrate by a simple dipping or padding process. Thus, the user need not measure the amount of composition necessary to obtain fabric softness. Additionally, the flat configuration of the sheet provides a large surface area which results in efficient release of the softener materials onto fabrics by the tumbling action of the dryer.

The water-insoluble paper, or woven or nonwoven substrates used in the articles hwerein can have a dense, or more preferably, open or porous structure. Examples of suitable materials which can be used as substrates herein include paper, woven cloth, and nonwoven cloth. The term "cloth" herein means a woven or nonwoven substrate for the articles of manufacture, as distinguished from the term "fabric" which encompasses the clothing fabrics being dried in an automatic dryer.

Highly preferred paper, woven, or nonwoven "absorbent" substrates useful herein are fully disclosed in Morton, U.S. Pat. No. 3,686,025, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) of from 2 to 25 times its weight of water.

Determination of absorbent capacity values is made by using the capacity testing procedures described in U.S. Federal Specifications UU-T-595b, modified as follows:

(1) tap water is used instead of distilled water;
(2) the specimen is immersed for 30 seconds instead of 3 minutes;
(3) draining time is 15 seconds instead of 1 minute; and
(4) the specimen is immediately weighed on a torsion balance having a pan with turned-up edges.

Absorbent capacity values are then calculated in accordance with the formula given in said Specification. Based on this test, one-ply, dense bleached paper (e.g., kraft or bond having a basis weight of about 32 pounds per 3,000 square feet −52 kg. per 1000 sq. meters) has an absorbent capacity of 3.5 to 4; commercially available household one-ply toweling paper has a value of 5 to 6; and commercially available two-ply household toweling paper has a value of 7 to about 9.5.

Using a substrate with an absorbent capacity of less than 2 tends to cause too rapid release of the softening agent from the substrate resulting in several disadvantages, one of which is uneven softening of the fabrics. Using a substrate with an absorbent capacity over 25 is undesirable, inasmuch as too little of the softening agent is released to soften the fabrics in optimal fashion during a normal drying cycle. If the substrate is a woven or nonwoven cellulosic cloth or paper, rather than a foamed plastic material, the absorbency should preferably be in the range of 2 to 15, most preferably between 5 and 7. For foamed plastics, the absorbency is preferably in the range of from about 15 to about 22.

As noted above, suitable materials which can be used as a substrate in the invention herein include, among others, sponges, paper, and woven and nonwoven cloth, all having the necessary absorbency requirements defined above. The preferred substrates of the softening compositions herein are cellulosic, polyester or polyester/cellulosic blends, particularly multi-ply paper and nonwoven cloth.

A more detailed description of multi-ply paper and nonwoven cloth materials which are suitable for use as substrates in dryer-added fabric softener articles of the type herein is given in U.S. Pat. No. 4,022,938, Zaki et al., issued May 10, 1977, incorporated herein by reference. See especially Col. 11 to Col. 13 of said patent.

The preferred fabric softening articles of the present invention are structured to be compatible with conventional laundry dryer designs. While it is preferred to employ the articles of the present invention in an automatic laundry dryer, other equivalent machines can be employed, and in some instances, heat and drying air may be omitted for part or all of the cycle. Generally, however, heated air will be employed and such air will be circulated frequently in the dryer. Normally, there are from about 5 to 50 volume changes of drying air in the dryer drum per minute and the air moves at about 125 to 175 cubic feet per minute (3.5 to 4.9 cu. meters per minute). These changing volumes of air create a drawing or suction effect which can, especially with small fabric loads, cause an item such as a sock, handkerchief or the like, or a fabric conditioning article, to be disposed on the surface of the air outlet of the dryer. A usual load of fabrics of from about 4 to about 12 pounds (1.8 to 5.4 kilograms) dry weight will fill from about 10% to about 70% of the volume of most dryers and will normally pose little difficulty. A sufficient number of tumbling items will normally be present to prevent any item from being drawn to the exhaust outlet, or to cause the item to be removed from the outlet in the event the item does become drawn against it. In the event, a fabric softening article is caused to be disposed in relation to the air exhaust outlet in such a manner as to cause blockage of passing air, undesirable temperature increases can result. In the case of fabric softening articles prepared from the normally solid or waxy softeners such as the amine salts herein, which soften or melt under conditions of heat, the article may tend to adhere to an exhaust outlet.

The problem of blockage can be solved by providing openings in the article in manner described in two U.S. patents to A. R. McQueary, U.S. Pat. No. 3,944,694 and U.S. Pat. No. 3,956,556, issued Mar. 16, 1976, and May 11, 1976, respectively, both incorporated herein by reference. More specifically, as described in these patents, slits or holes are cut through the substrate.

ARTICLE MANUFACTURE

The articles herein comprise tertiary amine salt-containing softener compositions in combination with any dispensing means suitable for releasing the softening composition to the fabric load at temperatures encountered in automatic laundry dryers. Preferred articles herein are those wherein the softening composition is releasably affixed to an absorbent substrate as an impregnate or as a coating. The impregnation or coating can be accomplished in any convenient manner, and many methods are known in the art. For example, the softening composition, in liquid form, can be sprayed onto a substrate or can be added to a wood-pulp slurry from which the substrate is manufactured.

Impregnating, rather than coating, the substrate with the softener composition is highy preferred for optimal softening with minimal fabric staining. The term "coating" connotes the adjoining of one substance to the external surface of another; "impregnating" is intended to mean the permeation of the entire substrate structure, internally as well as externally. One factor affecting a given substrate's absorbent capacity is its free space. Accordingly, when a softening composition is applied to an absorbent substrate, it penetrates into the free space; hence, the substrate is deemed impregnated. The free space in a substrate of low absorbency, such as a one-ply kraft or bond paper, is very limited; such a substrate, is therefore, deemed "dense." Thus, while a small portion of the softening composition penetrates into the limited free space available in a dense substrate, a rather substantial balance of the softener composition does not penetrate and remains on the surface of the substrate so that it is deemed a coating. The difference between coating and impregnation is believed to explain why the softener-impregnated sheet substrates of the invention herein substantially reduce the staining of fabrics observed when a softener-coated dense substrate is utilized.

In one method of making the preferred softener-impregnated absorbent sheet substrate, a softener composition containing a tertiary amine salt, alone or with the optional additives, is applied to absorbent paper or nonwoven cloth by a method generally known as "padding." The softening composition is preferably applied in liquid form to the substrate. Thus, the softener composition, which is normally solid at room temperature should first be melted and/or solvent treated with one of the liquid carriers mentioned hereinbefore. Methods of melting the softener composition and/or for treating the softener composition with a solvent are known and can easily be done to provide a satisfactory softener-treated substrate.

In another preferred method, the softener composition, in liquified form, is placed in a pan or trough which can be heated to maintain the softener composition in liquid form. The liquid softener composition contains any of the desired optical additives. A roll of absorbent paper (or cloth) is then set up on an apparatus so that it can unroll freely. As the paper or cloth unrolls, it travels downwardly and, submersed, passes through the pan or trough containing the liquid softener at a slow enough speed to allow sufficient impregnation. The absorbent paper or cloth then travels upwardly and through a pair of rollers which remove excess bath liquid and provide the absorbent paper or cloth with about 1 to about 12 grams of the softening composition per 100 sq. inches to 150 sq. inches (645 to 968 sq. cm.) of substrate sheet. The impregnated paper or cloth is then cooled to room temperature, after which it can be folded, cut or perforated at uniform lengths, and subsequently packaged and/or used.

The rollers used resemble "squeeze rolls" used by those in the paper and paper-making art; they can be made of hard rubber or steel. Preferably, the rollers are adjustable, so that the opening between their respective surfaces can be regulated to control the amount of the softener composition liquid on the paper or cloth.

In applying the softener composition to the absorbent substrate, the amount of softener composition (excluding any solvent which may have been used in the process) impregnated into or coated onto the absorbent substrate is conveniently in the weight ratio range of from about 10:1 to 0.5:1 based on the ratio of total softener composition to dry, untreated substrate (fiber plus binder). Preferably, the ratio of softener composition to dry, untreated substrate ranges from about 5:1 to about 1:1, most preferably from about 3:1 to 1:1. As noted above, the softening composition can contain from 5% to 100% of the tertiary amine salt softening agent.

Following application of the liquified softener composition, the articles are held at room temperature until the softener composition solidifies. The resulting dry articles, prepared at the softener composition:substrate ratios set forth above, remain flexible; the sheet articles are suitable for packaging in rolls. The sheet articles can optionally be slitted or punched to provide a non-blocking aspect (as described previously) at any convenient time during the manufacturing process.

The most highly preferred articles herein are those where the softener composition is releasably affixed to a woven or nonwoven cloth substrate of the type disclosed hereinabove having an absorbent capacity of from about 2 to about 15. A highly preferred substrate for such an article has an absorbent capacity of from about 5 to 7. The most highly preferred substrate for the articles comprises a water-laid or air-laid nonwoven cloth consisting essentially of cellulosic fibers, said fibers having a length of about 3/16 inch to about 2 inches and a denier from about 1.5 to about 5, said fibers being at least partially oriented haphazardly, and adhesively bonded together with a binder-resin. Such water-laid or air-laid nonwoven cloths can easily be prepared having the preferred absorbent capacities set forth above.

The most highly preferred articles herein are those wherein the flexible substrate is provided with openings sufficient in size and number to reduce restriction by said article of the flow of air through the automatic dryer. Articles wherein the openings comprise a plurality of rectilinear slits extending along one dimension of the substrate, especially whose wherein the slits extend to within 1 inch from at least on edge of said dimension of the substrate, articles wherein the slits comprise a plurality of curvilinear slits in a continuous pattern of U-shaped or C-shaped slits, and articles wherein the openings comprise circular holes, are highly preferred herein.

It is most convenient to provide an article in the form of a nonblocking sheet substrate having the physical parameters noted hereinabove, said substrate having an area of from about 50 sq. in. to about 200 sq. in. (322 sq. cm. to 1290 sq. cm.), containing from about 1.5 grams to about 7.5 grams of the softening composition releasably impregnated in said substrate. The articles are provided with openings such as the holes or slits described hereinabove, said openings comprising from about 0.5% to about 75%, preferably 5% to about 40%, of the area of the article, said openings being so disposed as to provide a nonblocking effect.

USAGE

In the method aspect of this invention the tertiary amine salt-containing softening compositions are used in an effective amount to soften and condition fabrics in an automatic laundry dryer. The effective, i.e., softening and static-controlling, amount of the composition used in the manner of this invention will depend somewhat on the type of fabric being treated and the dampness of the surrounding atmosphere. For example, it is well known that under conditions of low humidity, static control in fabrics is somewhat more difficult to achieve than under conditions of high humidity.

For most purposes, the composition is applied to fabrics at a rate of about 0.01 gram to about 12 grams, preferably 1 gram to about 4 grams, per 5 lbs. (2.25 kg.) of fabrics on a dry fabric weight basis. Higher usage rates can be employed, if desired, but can result in an undesirable greasy feel on the fabrics.

The method herein is carried out in the following manner. Damp fabrics, usually containing from about 1 to about 1.5 times their weight of water, are placed in the drum of an automatic clothes dryer. In practice, such damp fabrics are commonly obtained by laundering, rinsing and spin-drying the fabrics in a conventional washing machine. The amine salt either alone or in combination with other additives is simply spread uniformly over all fabric surfaces, for example, by sprinkling an amine salt-containing composition onto the fabrics from a shaker device. Alternatively, the amine salt-containing compositions can be sprayed into the dryer containing the fabrics or onto the dryer drum. The dryer is then operated in standard fashion to dry the fabrics, usually at a temperature from 35° C. to 115° C. (more typically from about 50° C. to about 85° C.) for a period from about 10 minutes to about 60 minutes, depending on the fabric load and type. On removal from the dryer, the dried fabrics are softened. Moreover, the fabrics instantaneously sorb a minute quantity of water which increases the electrical conductivity of the fabric surfaces, thereby quickly and effectively dissipating static charge.

In a preferred mode, the present process is carried out by fashioning an article comprising the substrate-like dispensing means of the type hereinabove described in releasable combination with a tertiary amine salt-containing softener composition. This article is simply added to a clothes dryer together with the damp fabrics to be treated. The heat and tumbling action of the revolving dryer drum evenly distributes the softener composition over all fabric surfaces, and dries the fabrics.

The amine salts herein also perform well as fabric softeners when added to the rinse cycle of a typical washing operation. Thus, articles of the invention can be added to the rinse water. Alternatively, an aqueous concentrate containing from about 5% to 10% by weight amine salt can be prepared and sufficient amount of this concentrate can be added to the rinse water to produce a concentration of from about 30 to about 60 ppm amine salt in the rinse water. Also the amine salts herein are more compatible with anionic detergents than conventional quaternary ammonium softeners, and thus can be added, at levels of from about 30–60 ppm, directly to the wash cycle of a typical washing operation, thereby softening the fabrics at the same time they are being washed.

The following are nonlimiting examples of the instant articles and methods.

EXAMPLE I

Preparation of Tertiary Amine Salts

Several tertiary amine salts of the present invention were made according to the following procedure.

The amine was placed in a glass vessel. An amount of the desired acid, calculated to be stoichiometrically equivalent to the amount of amine was added to the amine and the mixture was stirred at 65° C. to 77° C. for approximately 10 minutes, thereby forming the amine salt. The amine salt was then solidified by cooling it to room temperature.

Stearyldimethylamine hydrochloride was also prepared. This compound was made by adding a stoichiometric amount of 37% aqueous HCl to stearyldimethylamine at room temperature. The resulting thick paste was then spread on a heated metal plate (about 90° C.–100° C.) to complete the reaction and drive off the water.

Preparation of Fabric Softening Articles

Fabric softening articles comprising a rayon nonwoven fabric substrate (having a weight of 1.52 grams per 639 sq. cm.) and an amine salt softening agent were prepared in the following manner.

The substrate was passed through a trough containing the melted softener and then was drawn between a pair of rollers to squeeze off the excess molten softener. The treated substrate was then cooled to room temperature to solidify the softener, cut into 22.86 cm.×27.94 cm. sheets, and six evenly-spaced parallel slits were then cut into each sheet within about 2.54 cm. of opposite ends of the sheets. The softener was present on the sheets at a weight ratio of about 2.1 to 1 softener:substrate.

In the case of stearyldimethylamine hydrochloride, the salt was applied to the substrate at room temperature in a 50/50 methanol/chloroform solvent mixture. The solvent mixture was then evaporated from the substrate.

Fabric Softening Performance

The fabric softening performance of the above-described articles was evaluated in a Sears Kenmore Electric Dryer (on the standard 45 minute timed cycle, 50° C.–70° C.), using a previously washed standardized mixed fabric load, which contained four terry cloth towels as fabric softness test pieces. The mixed fabric load was washed in a Sears Kenmore Washer with the recommended amount of CHEER$^R$ DETERGENT (77 grams in 64.3 liters of water) and subjected to a warm water rinse before treatment in the dryer.

Fabric softening was evaluated on the four terry cloth towels from the respective test loads, using as controls, a similar set of fabrics which was unsoftened, and sets which had been softened in rinse application of DOWNY$^R$ fabric softener and in a dryer application of BOUNCE$^R$ fabric softener. These two trademarked products are both products of The Procter & Gamble Company. DOWNY is a liquid fabric softener marketed for use in the rinse cycle, and BOUNCE is a softener-impregnated web sheet article marketed for use in the dryer. The softness evaluation was done by round robin paired comparison grading by a panel of three judges who assigned numerical softeness difference scores to the graded pairs on a scale of 0 to 4, where 0 is "no difference" and 4 is "a whole lot softener." A computerized analysis of variance program summarized the individual treatment scores. The results were mathematically "normalized" by adjusting the panel score obtained on the unsoftened fabrics to "0" and making an adjustment of the same magnitude to the scores obtained on the fabrics for each of the other treatments. A difference of about 0.3 to 0.4 panel score units between treatments is statistically significant. By using the "0" normalization technique noted above, it is possible to make valid comparisons between treatments which have not been directly compared against each other in the same test run.

The release weight of softening composition from the nonwoven softening article to fabrics was determined by comparing the weight of the article before and after use, and calculating the weight % of composition which was removed from the article.

Results on several amine salts of the invention and on an amine hydrochloride salt are shown in the following table.

TABLE I

| Amine Salt | Melting Point °C. | Softness Panel Score | Percent Release |
|---|---|---|---|
| Stearyldimethylamine hydrochloride | 104° | 0.9 | 20 |
| Stearyldimethylamine stearate | 58° | 2.1 | 91 |
| Stearyldimethylamine formate | 42° | 2.3 | 97 |
| Stearyldimethylamine myristate | 35° | 2.3 | 96 |
| Stearyldimethylamine palmitate | 49° | 2.3 | 95 |
| Ditallowmethylamine myristate | 48° | 1.8 | 93 |
| Ditallowmethylamine laurate | 34° | 1.7 | 98 |
| Ditallowmethylamine palmitate | 53° | 1.4 | 89 |
| Ditallowmethylamine stearate | 57° | 1.4 | 92 |
| BOUNCE[1] | — | 1.2 | 65 |
| DOWNY[2] | — | 2.6 | — |

[1]Softener is an 80/20 mixture of sorbitan monostearate/ditallowdimethylammonium methylsulfate.
[2]Softener is distearyldimethylammonium chloride.

EXAMPLE II

An article of the invention utilizing the following softening composition is prepared.

| | |
|---|---|
| Amine salt | 89% |
| Gelwhite GP clay | 8 |
| Perfume | 3 |
| | 100% |

The amine salt is a 40/60 mixture of stearyldimethylamine stearate and ditallowmethylamine myristate. The individual amine salts are prepared according to the procedure in Example I. The amine salts are heated to a temperature of 66° C. to 77° C. and mixed together. The clay is added to this liquid mixture and dispersed in the mixture via-shear mixing. The perfume is then blended into the mixture. The hot liquid mixture is then applied to a nonwoven rayon substrate in the manner described in Example I to produce a softener composition: substrate ratio of 2.1:1. The treated substrate is then cut into 27.94×27.94 cm. sheets and slitted in the manner described in Example I. This article, when added to a five-pound load of fabrics in a laundry dryer, which is operated at about 66° C. for 45 minutes, produces excellent fabric softening and antistatic benefits.

What is claimed is:

1. An article of manufacture adapted for providing fabric softening within an automatic clothes dryer, said article comprising:

(a) a fabric softening amount of a fabric softening composition comprising from about 5% to about 100% of a carboxylic acid salt of a tertiary amine having the formula

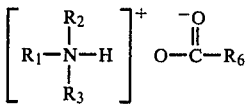

wherein $R_1$ is a long chain aliphatic group containing from 12 to 22 carbon atoms and $R_2$ and $R_3$ can be the same or different from each other and are selected from the group consisting of aliphatic groups containing from 1 to 22 carbon atoms, hydroxyalkyl groups of the formula $—R_4OH$ wherein $R_4$ is an alkylene group of 1 to 3 carbon atoms, and alkyl ether groups of the formula $R_5O(C_nH_{2n}O)_m—$ wherein $R_5$ is selected from the group consisting of alkyl and alkenyl of from 1 to 20 carbon atoms and hydrogen, n is 2 or 3 and m is from 1 to 20, and wherein $R_6$ is selected from the group consisting of unsubstituted alkyl, alkenyl, aryl, alkaryl and aralkyl of 11 to 21 carbon atoms, and substituted alkyl, alkenyl, aryl, alkaryl, and aralkyl of from 11 to 21 carbon atoms wherein the substituents are selected from the group consisting of halogen, carboxyl, and hydroxyl, said composition having a melting point between about 35° C. and about 100° C.; and (b) a dispensing means which provides for release of said softening composition to fabrics within an automatic laundry dryer at dryer operating temperatures.

2. The article of claim 1 wherein the softening composition comprises from about 50% to about 100% of the amine salt.

3. The article of claims 1 or 2 wherein $R_2$ is an aliphatic chain of from 1 to 22 carbon atoms, $R_3$ is an aliphtic chain of from 1 to 3 carbon atoms and $R_6$ is an unsubstituted alkyl or alkenyl group of from 11 to 21 carbon atoms and wherein the composition has a melting point of from about 35° C. to about 85° C.

4. The article of claim 3 wherein the carboxylic acid salt forming anion moiety is selected from the group consisting of lauric, myristic, palmitic, stearic and oleic and mixtures thereof.

5. The article of claim 3 wherein the dispensing means is a flexible substrate of woven or nonwoven material in sheet form, having said softening composition releasably affixed thereto, and wherein the weight ratio of softening composition to substrate is from about 10:1 to about 0.5:1, and wherein the substrate has an absorbent capacity of from about 2 to about 25.

6. The article of claim 5 wherein the amine salt is selected from the group consisting of stearyldimethylamine stearate, distearylmethylamine myristate, stearyldimethylamine palmitate, disterylmethylamine palmitate, distearylmethylamine laurate and mixtures thereof.

7. The article according to claim 6 wherein the substrate is a woven or nonwoven cellulosic, polyester or polyester/cellulose cloth or paper and has an absorbent capacity of from about 2 to about 15.

8. The article of claim 6 wherein the substrate is a foamed plastic sheet having an absorbent capacity of from about 15 to about 25.

9. The article of claims 7 or 8 wherein the amine salt comprises a mixture of stearylidimethylamine stearate and distearylmethylamine myristate in a weight ratio of from 1:10 to 10:1.

10. The article of claim 3, wherein the dispensing means is an aerosol device.

11. A method for imparting a softening and antistatic effect to fabrics in an automatic clothes dryer comprising tumbling said fabrics under heat in said dryer with an effective amount of a fabric softening composition comprising from 5% to 100% of a tertiary amine salt of the formula

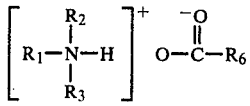

wherein $R_1$ is a long chain aliphatic group containing from 12 to 22 carbon atoms $R_2$ and $R_3$ can be the same or different from each other and are selected from the group consisting of aliphatic groups containing from 1 to 22 carbon atoms, hydroalkyl groups of the formula $—R_4OH$ wherein $R_4$ is an alkylene group of 1 to 3 carbon atoms, and alkyl ether groups of the formula $R_5O(C_nH_{2n}O)_m—$ wherein $R_5$ is selected from the group consisting of alkyl and alkenyl of from 1 to 22 carbon atoms and hydrogen, n is 2 or 3 and m is from 1 to 20, and wherein $R_6$ is selected from the group consisting of unsubstituted alkyl, alkenyl, aryl, alkaryl and aralkyl of 11 to 21 carbon atoms, and substituted alkyl, alkenyl, aryl, alkaryl, and aralkyl of from 11 to 21 carbon atoms wherein the substituents are selected from the group consisting of halogen, carboxyl, and hydroxyl, said composition having a melting point between about 35° C. and about 100° C.

12. The method of claim 11 wherein the said composition comprises from about 50% to about 100% of said tertiary amine salt.

13. The method of claim 11 or 12 wherein $R_2$ is an aliphatic chain of from 1 to 22 carbon atoms, $R_3$ is an aliphatic chain of from 1 to 3 carbon atoms and $R_6$ is an unsubstituted alkyl or alkenyl group of from 11 to 21 carbon atoms and wherein the composition has a melting point of from about 35° C. to about 85° C.

14. The method of claim 13 wherein the carboxylic acid salt forming anionic moiety is selected from the group consisting of lauric, myristic, palmitic, stearic and oleic.

15. The method of claim 13 wherein the composition is dispensed within the dryer from a flexible substrate of woven or nonwoven material having said softening composition releasably affixed thereto.

16. The method of claim 15 wherein the amine salt is selected from the group consisting of stearyldimethylamine stearate, distearylmethylamine myristate, stearyldimethylamine palmitate, distearylmethylamine palmitate, distearylmethylamine laurate and mixtures thereof.

17. The method of claim 16 wherein the amine salt is a mixture of stearylmethylamine stearate and distearylmethylamine myristate in a weight ratio of from 1:10 to 10:1.

18. The method of claim 13 wherein the composition is dispensed into the dryer from an aerosol device.

19. The method of claim 18 wherein the amine salt is a mixture of stearylmethtylamine stearate and distearylmethylamine myristate in a weight ratio of from 1:10 to 10:1.

* * * * *